US007191999B2

(12) United States Patent
Hensley et al.

(10) Patent No.: US 7,191,999 B2
(45) Date of Patent: Mar. 20, 2007

(54) VARIABLE HEIGHT SIDEFORMS

(75) Inventors: Jason Hensley, Shakopee, MN (US); Michael LeJeune, Wayzata, MN (US); Thomas Kuckhahn, Prior Lake, MN (US); Donald Hall, New Prague, MN (US)

(73) Assignee: Fabcon, Inc., Savage, MN (US)

( * ) Notice: Subject to any disclaimer, the term of this patent is extended or adjusted under 35 U.S.C. 154(b) by 281 days.

(21) Appl. No.: 10/806,901

(22) Filed: Mar. 23, 2004

(65) Prior Publication Data

US 2005/0214397 A1 Sep. 29, 2005

(51) Int. Cl.
*B28B 7/02* (2006.01)

(52) U.S. Cl. ..... 249/155; 249/139; 249/161; 249/166; 249/167; 249/68; 425/125

(58) Field of Classification Search ..... 425/125; 249/139, 155, 161, 166, 167, 68
See application file for complete search history.

(56) References Cited

U.S. PATENT DOCUMENTS

| | | | | |
|---|---|---|---|---|
| 3,217,375 | A | 11/1965 | Kinnard | |
| 3,523,343 | A | 8/1970 | Mitchell | |
| 4,004,874 | A | 1/1977 | Foster | 425/738 |
| 4,041,669 | A | 8/1977 | Rauenhorst | 52/576 |
| 4,141,946 | A | 2/1979 | Rauenhorst | 264/69 |
| 4,289,293 | A | 9/1981 | Cashion | 249/74 |
| 4,369,153 | A | 1/1983 | Nash et al. | 425/120 |
| 4,457,682 | A | 7/1984 | Nash et al. | 425/219 |
| 4,628,653 | A | 12/1986 | Nash | 52/309.12 |
| 5,393,033 | A * | 2/1995 | Wilson | 249/155 |
| 6,793,476 | B2 * | 9/2004 | Bryja et al. | 425/145 |
| 2003/0189158 | A1 * | 10/2003 | Vappula | 249/139 |

* cited by examiner

*Primary Examiner*—Yogendra N. Gupta
*Assistant Examiner*—Maria Veronica Ewald
(74) *Attorney, Agent, or Firm*—Vidas, Arrett & Steinkraus P.A.

(57) ABSTRACT

An improvement to concrete casting machines of the casting bed type in which the side forms are constructed and arranged to stay in an upright position at all times but may be raised and lowered.

7 Claims, 4 Drawing Sheets

VARIABLE HEIGHT SIDEFORMS

CROSS-REFERENCE TO RELATED APPLICATIONS

STATEMENT REGARDING FEDERALLY SPONSORED RESEARCH OR DEVELOPMENT

Not Applicable.

BACKGROUND OF THE INVENTION

Previously, hollow core concrete panels have been formed by many methods, including single and multiple pass casting using moving beds and with stationary beds. The hollow cores are made by using slipform extruders that leave core material in place over which concrete is formed. Once cured, the panels are cut to length and lifted and tilted to remove the core material which may be reused.

Some hollow core panels have been made with an insulating layer across the entire surface, as shown in U.S. Pat. No. 4,628,653, the disclosure of which is incorporated herein by reference. Basically, a hollow core panel is cast and interlocking sheets of insulation are laid down before a final pour of concrete. This uniform layer of insulation increases the R-value of the finished wall panels and floor plank.

U.S. Pat. Nos. 4,041,669 and 4,141,946, the disclosures of which are incorporated herein by reference, describe a hollow-core concrete slab in which an inverted U-shaped foam piece is manually placed on a first layer of concrete that is ridged by a screed. The inverted U-shapes define a hollow void that remains after the second pour of concrete is made over the foam.

U.S. Pat. No. 4,369,153 which issued Jan. 18, 1983 to Nash et al discloses a machine which casts hollow core concrete panels in a single casting operation utilizing a slip form technique to fill cores with core material which can be dumped from the core after curing of the concrete has been accomplished. U.S. Pat. No. 4,369,153 is incorporated herein by reference.

In single casting operations, hollow core concrete panels are formed on a moving bed in which concrete is first poured around the front end of a slip form which forms the bottom layer of the concrete panel. The bed moving past the slip form shapes the bottom layer of the concrete panel. As the concrete travels on the bed past the slip form, core material which may be an aggregate is fed into openings in the slip form to fill the desired cores with core material. Alternatively, the bed may be stationary and the slip form may move relative to the bed.

This invention relates to a machine for casting concrete members such as planks and panels, with or without hollow cores. Such beds are typically extremely long and may be 600 feet or more in length. The buildings that house these machines are built to accommodate the machines. The cast panels or planks vary in width according to the maximum width of the machine. Once a factory with machines has been built, it is very difficult to depart from the capabilities of the machines in place due to constraints in the size of the building and the casting beds.

Prior art casting machines have side forms that release and drop away from the beds to remove the cured concrete panels. The existing side forms are dropped down from the bed. Unfortunately, this makes it even more difficult to modify an existing machine to increase the width of the finished panels or plank since additional width must be reserved for the height of the side forms as they drop away.

The art described in this section is not intended to constitute an admission that any patent, publication or other information referred to herein is "prior art" with respect to this invention, unless specifically designated as such. In addition, this section should not be construed to mean that a search has been made or that no other pertinent information as defined in 37 C.F.R. § 1.56(a) exists.

BRIEF SUMMARY OF THE INVENTION

The invention provides a new casting bed that requires less overall width by pivoting the side forms down while maintaining a vertical position. The side forms are pivoted in a manner that allows them to move up, down and sideways but not laterally off of vertical. An additional advantage to such a side form is that the side form is infinitely adjustable in height so different panel thicknesses may be cast with the same side forms instead of requiring a different set of side forms for a different thickness.

BRIEF DESCRIPTION OF THE DRAWINGS

A detailed description of the invention is hereafter described with specific reference being made to the drawings in which.

DETAILED DESCRIPTION OF THE INVENTION

Figure 1:
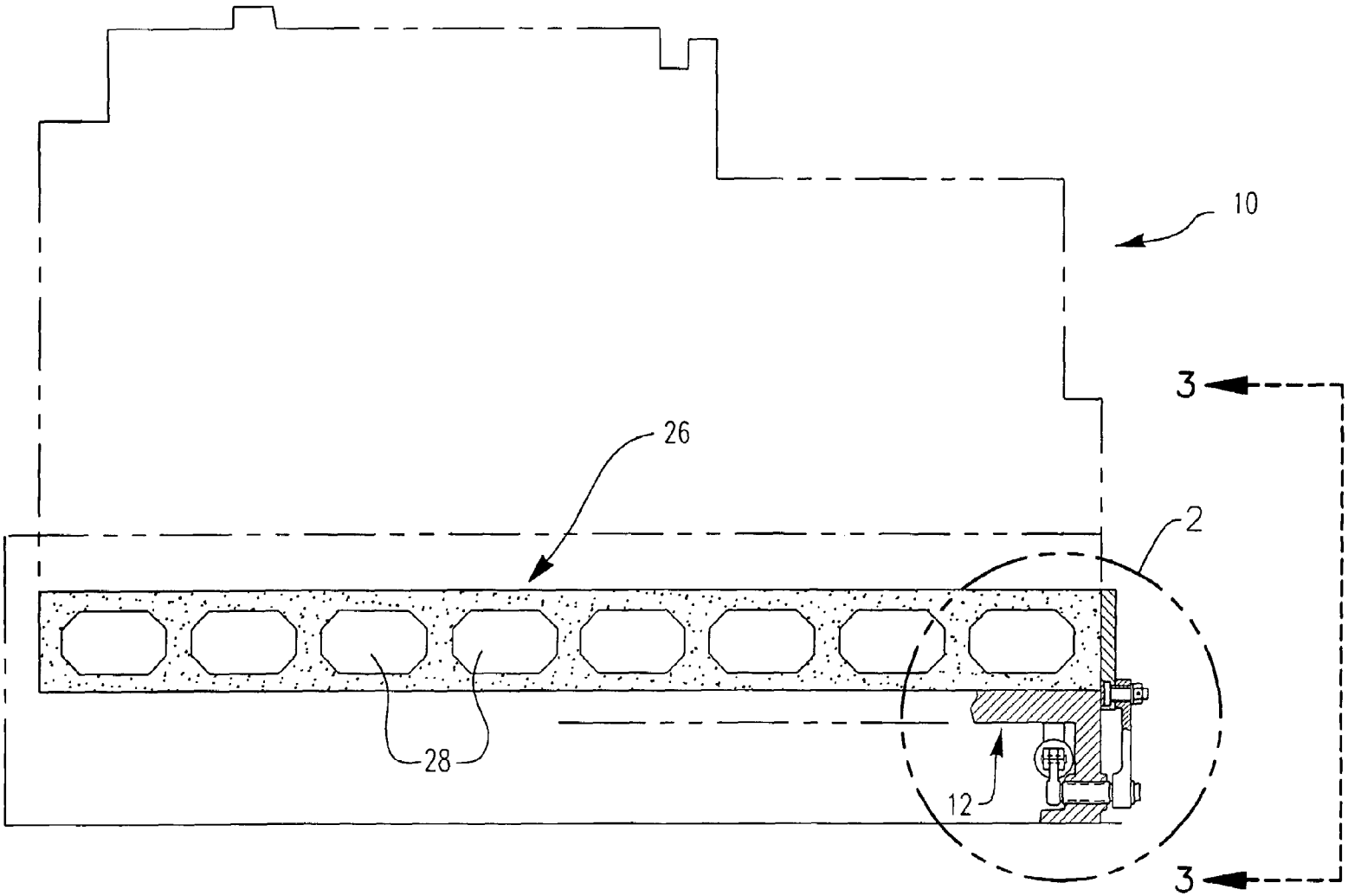
FIG. 1 is a section in elevation showing the inventive side forms.
Figure 2:
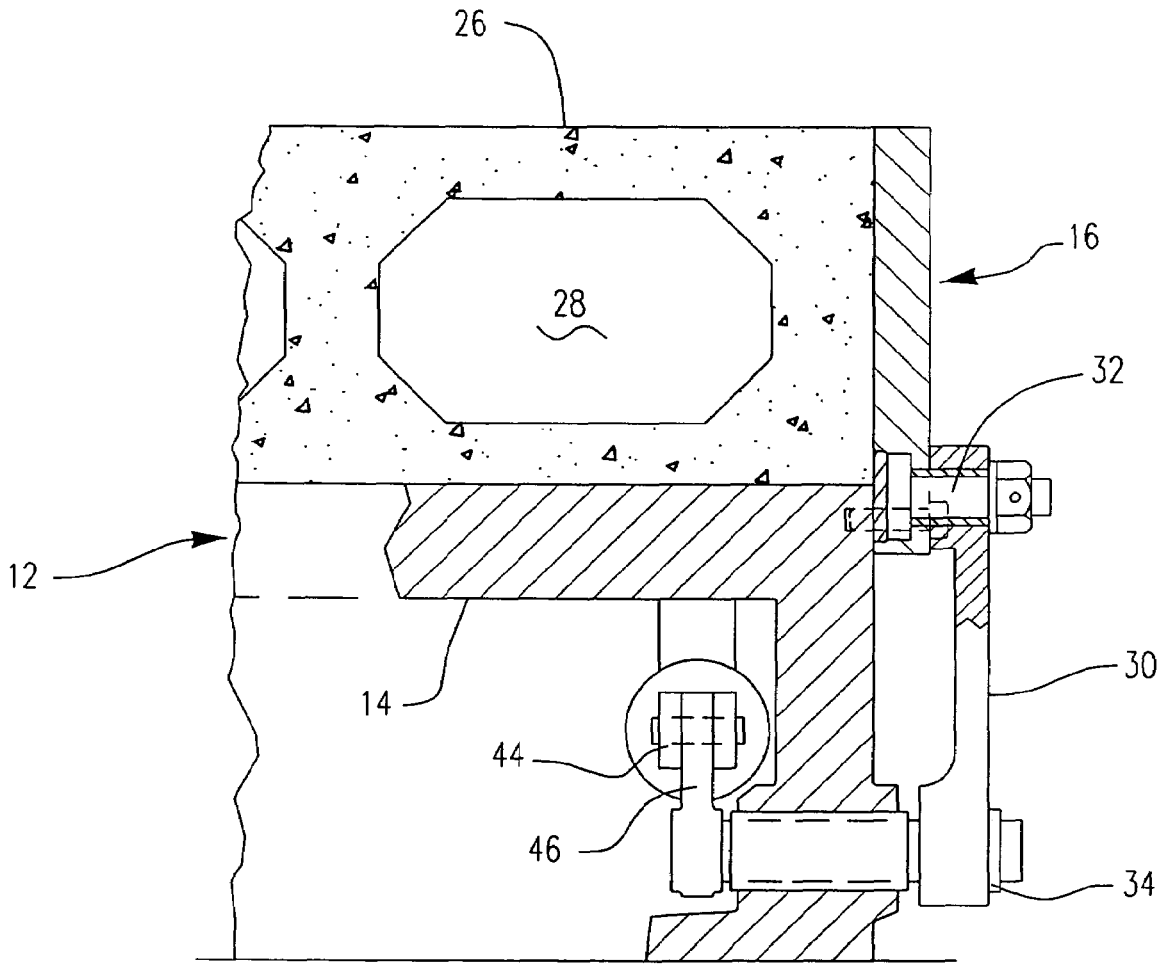
FIG. 2 is a fragmentary view thereof taken from the area encircled at 2 in FIG. 1.

The inventive machine of the invention basically modifies any standard concrete casting apparatus as shown in U.S. Pat. Nos. 3,217,375; 3,523,343; 4,004,874; 4,289,293 and 4,457,682, the disclosures of which are incorporated herein by reference. Such casting machines have a casting bed 10 that is either stationary or is driven along rails. The casting bed has a bottom pallet 14 and side forms 16, 18. A completed concrete panel 26 is shown in FIG. 1 and typically has a plurality of longitudinal voids 28 which decrease the weight of the finished panel. Alternatively, they may be filled with insulating foam or may be absent, as dictated by the customer's needs.

In prior casting beds, the side forms pivot out and away from the concrete panel 26 thereby greatly increasing the required overall width of the space needed for the casting machine. In this invention, the side forms 16 (one side of which is shown) include pivot arms 30 and pivot points 32, 34 which are tied to the side forms 16 at their top and to the bottom of the casting bed 10. A hydraulic mechanism 40 is shown which may slide the side forms up and down with a longitudinal sliding motion that raises and lowers the side forms rather than dropping them outwardly. The hydraulic mechanism 40 would have a fixed end 42 and a floating end 44 attached by a linkage 46 which moves the side forms 16 up and down depending on the position of the hydraulic piston 50. In this case, the linkage 30 would be attached at its bottom pivot point 34 to the linkage 46 rather than to a fixed point on the casting bed.

Figure 3:
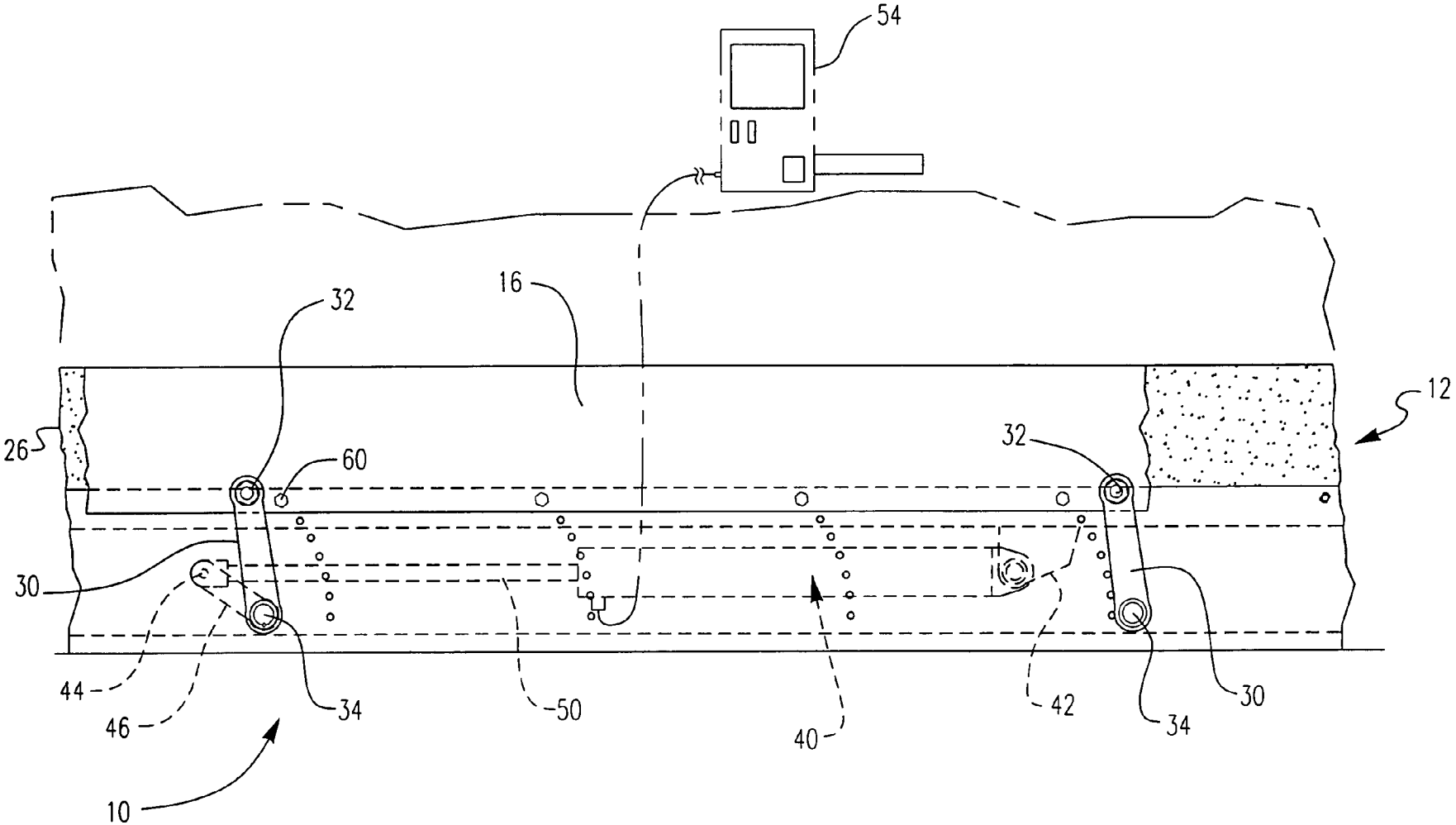
FIG. 3 is a side elevation thereof taken along line 3—3 in FIG. 1.
Figure 4:
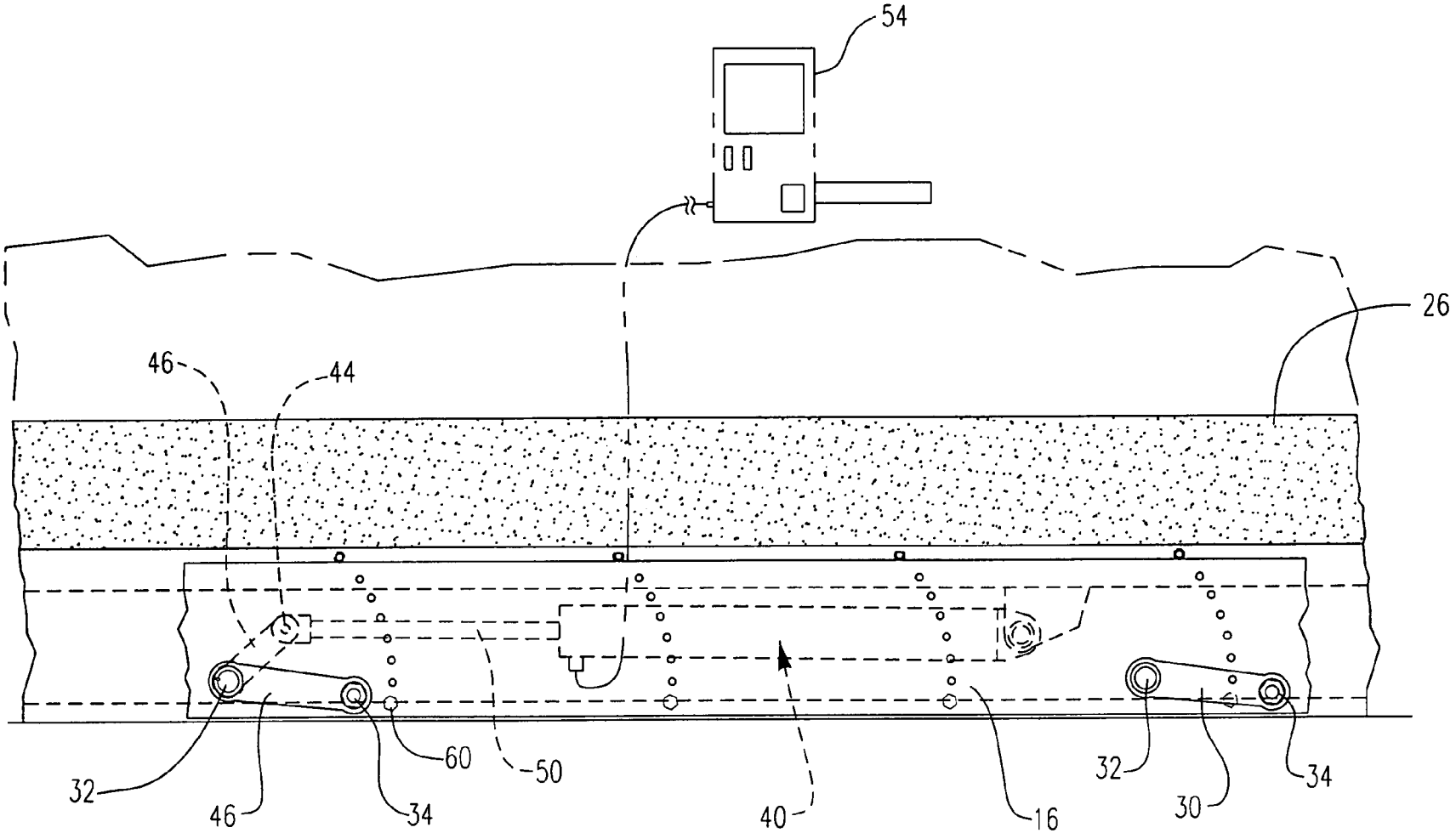
FIG. 4 is a view similar to that of FIG. 3 with movable parts shown fully advanced from their positions in FIG. 3.

FIG. 3 shows a side form 16 raised for casting the concrete panels and FIG. 4 shows the side forms slid down and out of the way so the cast concrete panel may be cut and removed from the bed. It should be readily apparent that the side forms may be raised to the fullest extent for casting panels having a greater thickness and may be dropped partially if the concrete panel to be cast has a lower overall thickness.

The invention works for either the moving casting bed machines as shown or for stationary beds. In both cases less width is required for the casting operation and varying product thicknesses may be readily handled by simply adjusting the side form 16 heights with the hydraulic mechanism 40. The hydraulic mechanism 40 may be controlled by a controller represented by a control box 54 as is known in controlling hydraulics. Of course, while shown with a hydraulic system, any form of motive power may be used to raise and lower the side forms.

The side form 16 may benefit from an additional member that locks the side form at its desired height to counter the forces of the weight of concrete held within. Bolts 60 may be placed along the length of the bed that can secure the side forms to the bed after the height has been set. Alternatively, additional holding power may be provided with electromagnets which allows the side forms to have an on and off control of the additional resistance to outward movement that may be desired. Another mechanism that would provide extra side holding power could be an air bladder along the length of the bed which could inflate when desired.

While this invention may be embodied in many different forms, there are shown in the drawings and described in detail herein specific preferred embodiments of the invention. The present disclosure is an exemplification of the principles of the invention and is not intended to limit the invention to the particular embodiments illustrated.

This completes the description of the preferred and alternate embodiments of the invention. Those skilled in the art may recognize other equivalents to the specific embodiment described herein which equivalents are intended to be encompassed by the claims attached hereto.

The invention claimed is:

1. In a machine for casting concrete panels on a casting bed including a bottom and a pair of parallel side forms, the improvement comprising:

a) linkage members pivotally linking said side forms to a fixed position to allow up and down movement which keeps the side forms vertical at all times with respect to said casting bed, said linkage members pivotally linking said side forms such that the side forms move up, down, and back and forth but not outwardly from said casting bed;

b) a mechanism to fix the side forms at one of a plurality of heights with respect to said casting bed; and c) motive force mechanism linked to said side forms for driving said side forms up and down.

2. The machine of claim 1 wherein said motive force mechanism is hydraulic.

3. The machine of claim 1 wherein said mechanism to fix the height of said side forms includes a plurality of spaced openings such that said side forms may be set at one of a plurality of different heights by securing the linkage members relative to the side forms by bolt members to said spaced openings.

4. The machine of claim 1 wherein said mechanism to fix the height of said side forms includes a electromagnets positioned to provide a holding force to keep the side forms at a desired height once so positioned.

5. The machine of claim 1 wherein said mechanism to fix the height of said side forms includes an air bladder positioned along said side forms which upon inflation provides a holding force to keep the side forms at a desired height once so positioned.

6. The machine of claim 3 wherein said plurality of spaced openings are positioned to said side form such that said side form may be fixed to a set height by placing bolt members thereinto.

7. The machine of claim 3 wherein said plurality of spaced openings are positioned within said linkage members such that bolt members passed therethrough will fix the side forms to a set height based on the hole so fixed.

* * * * *